US005624269A

United States Patent [19]

Kanamori

[11] Patent Number: 5,624,269

[45] Date of Patent: Apr. 29, 1997

[54] ELECTRICAL CONTACT TERMINAL FOR PRINTED CIRCUIT BOARD

[75] Inventor: Hiroyasu Kanamori, Shizuoka, Japan

[73] Assignee: Yazaki Corporation, Tokyo, Japan

[21] Appl. No.: 487,286

[22] Filed: Jun. 7, 1995

[51] Int. Cl.[6] ..... H01R 9/09

[52] U.S. Cl. ..... 439/83; 439/876; 439/474

[58] Field of Search ..... 439/78, 80, 81, 439/82, 474, 876, 885, 83

[56] References Cited

U.S. PATENT DOCUMENTS

| | | | |
|---|---|---|---|
| 2,953,766 | 9/1960 | Clewes | 439/81 |
| 3,270,251 | 8/1966 | Evans | 439/80 |
| 4,487,463 | 12/1984 | Tillotson | 339/17 C |
| 4,979,903 | 12/1990 | Gosselin | 439/78 |
| 5,167,513 | 12/1992 | Johnson et al. | 439/78 |
| 5,188,535 | 2/1993 | Bertho et al. | 439/82 |
| 5,336,096 | 8/1994 | Ozawa et al. | 439/82 |
| 5,383,800 | 1/1995 | Saka et al. | 439/787 |
| 5,398,166 | 3/1995 | Yonezawa et al. | 361/784 |
| 5,519,586 | 5/1996 | Byrd | 361/833 |

FOREIGN PATENT DOCUMENTS

| | | | |
|---|---|---|---|
| 60-181867 | 12/1985 | Japan | 439/83 |
| 63-42472 | 11/1988 | Japan | 439/83 |
| 4-88666 | 7/1992 | Japan | 439/876 |

*Primary Examiner*—David L. Pirlot
*Assistant Examiner*—Tho D. Ta
*Attorney, Agent, or Firm*—Young & Basile, P.C.

[57] ABSTRACT

An electrical contact terminal for mounting on a printed circuit board has a point of primary electrical contact with the circuit board physically separated from a pair of load-bearing connections to the circuit board. Physical loads caused by relative movement between the printed circuit board and an electrical component attached to the terminal are borne by the load-bearing points while the point of primary electrical contact is isolated from those loads and therefore will not be subjected to stresses which cause degradation of the electrical connection.

13 Claims, 2 Drawing Sheets

ELECTRICAL CONTACT TERMINAL FOR PRINTED CIRCUIT BOARD

FIELD OF THE INVENTION

The present invention relates to an electrical contact terminal for mounting on a printed circuit board and more specifically to such a terminal having a pair of load-bearing legs which connect the terminal to the circuit board at points separate from the point of primary electrical contact between the terminal and a circuit of the printed circuit board.

BACKGROUND OF THE INVENTION

Printed circuit boards (PCBs) are commonly provided with terminals which serve as means for making electrical connections between the circuits of the PCB and other electrical components such as cables or other PCBs. To ensure a high quality electrical contact between the PCB circuits and the terminals, solder is often used to connect the two. In addition to providing electrical contact between the PCB and other electrical components, terminals are often subjected to physical stresses caused by relative movement between the PCB and the connecting component. Such relative movement can result from the act of connecting or disconnecting the PCB from the other component, by rough handling or vibration experienced during use, or by thermal expansion of the terminals themselves. If the physical stresses experienced by a terminal are applied to the soldered connection between the terminal and the PCB circuit, cracks may develop in the soldered connection, resulting in poor electrical continuity, physical weakening, and eventually complete failure.

To deal with the above described problem, some prior PCB terminals have included a connector housing which surrounds the terminals themselves and carries most of the physical loads that would otherwise be borne by the terminals. Such a housing, typically made from a plastic material, is attached to the PCB independently from the electrical connection of the terminals by screws, rivets or some other rigid fastening means. The component to be connected with the PCB features a mating connector which includes electrical contacts compatible with the PCB terminals. The mating connector rigidly engages the connector housing when electrical contact is made between the terminals and the contacts, such that physical loads caused by relative movement of the PCB and the other component is borne by the connector housing and the terminals themselves are substantially isolated from the loading. Thermal expansion and contraction of the metallic terminals takes place within the surrounding connector housing so that much lower loads are generated than would occur if the terminals served as the load bearing portion of the connection. This type of connection assembly entails the added cost and complexity of manufacturing the connector housing, assembling it with the terminals, and attaching it to the printed circuit board.

An alternative method of dealing with relative movement between a PCB and a connecting component is to allow the terminal to be the load-bearing component, but to make it flexible such that it will deflect when such relative movement occurs. The deflection of the terminal acts as a spring to absorb the loading rather than transmitting it to the soldered connections between the terminals and the PCB circuit. A terminal of this type is disclosed in Japanese Utility Model Unexamined Publication No. HEI-4-88666. While terminals of this type effectively absorb some of the loading caused by relative motion or thermal expansion and contraction, the fact that the only rigid connection between the terminal and the PCB is at the points where the terminal is soldered to the PCB circuit requires that all physical loads ultimately be transferred through those points. If the magnitude of the relative motion between the PCB and the mating electrical component is greater than the amount that can be absorbed by deflection of the terminal, stress is applied to the soldered connections between the PCB and the terminal, with the possible result of degradation or failure of the connections.

SUMMARY OF THE INVENTION

The present invention is directed toward an electrical contact terminal for mounting on a printed circuit board (PCB) and having a point of primary electrical contact with the PCB which is physically separate from one or more points of load-bearing attachment between the terminal and the PCB. The point of primary electrical contact is thereby substantially isolated from physical loads applied to the terminal.

In general, this is accomplished by providing a terminal comprised of a blade portion having a first end adapted to engage and make electrical contact with a separate electrical component, a base portion contiguous with the blade portion and adapted to rigidly engage the PCB such that physical loads applied to the blade portion are transferred to the PCB, a flexible spring member extending away from the base and blade portions, and a circuit connection portion connecting the end of the spring member with the PCB and making electrical contact therewith. The blade portion and base portion thus define a load-bearing path through which forces caused by relative movement between the connecting electrical component and the terminal are transmitted to the PCB, while the spring member and circuit connection portion provide the primary electrical path between the blade portion and the circuit of the PCB. The spring member is sufficiently flexible when compared to the rigidity of the base to PCB connection to substantially isolate the junction between the circuit connection portion and the PCB from physical forces applied to the blade portion.

According to a feature of the invention, when the terminal is mounted on the PCB, the load-bearing path formed by the blade portion and base portion is oriented substantially perpendicular to the PCB, and the spring member extends substantially parallel to the PCB. This configuration efficiently isolates the circuit connection portion from forces applied to the blade portion when the mating electrical component is pressed onto the blade portion to make connection therewith and pulled off of the blade portion to disconnect.

According to a further feature of the invention, the terminal is fabricated from a single plate of electrically conductive metal which is stamped and bent to the desired form. This provides a highly efficient method of manufacture and is well suited to mass production.

According to another feature of the invention, the base portion comprises a pair of load-bearing legs which extend perpendicularly from the lateral edges of the blade portion and have pins which engage holes formed in the PCB to firmly connect thereto. This configuration provides a rigid, two-point connection between the load-bearing path of the terminal and the PCB while occupying a relatively small amount of area on the PCB.

According to still another feature of the invention, the legs, in addition to serving as load-bearing members, also act as points of electrical contact between the terminal and a circuit of the PCB. These additional contact points may be used either as redundant contacts between the terminal and the circuit that the circuit connection portion is connected to, or to connect the terminal with other circuits of the PCB.

According to another feature of the invention, the legs are formed to be larger than is necessary for their load-bearing purpose so that they have a larger surface area and serve as heat dissipators.

According to yet another feature of the invention, a portion of the spring member has a cross-sectional area less than that of the adjoining circuit connection portion, thereby providing an area of increased flexibility which absorbs strain energy resulting from loads on the blade portion before it can be transmitted to the circuit connection portion.

In a preferred illustrative embodiment, the inventive terminal is formed from a single plate of electrically conductive metal and comprises a blade portion having a first end adapted to engage and make electrical contact with the connecting electrical component and an opposite second end having a pair of support legs extending perpendicularly from the lateral edges thereof. The support legs have pins formed on their lower ends to engage holes formed in the PCB such that the blade portion is maintained substantially perpendicular to the PCB. A spring portion projects from between the support legs at the second end of the blade portion, extending in the same direction as the support legs to lie in a plane substantially parallel with the PCB when the terminal is mounted thereon. A circuit connection portion extends from the end of the spring portion downward toward the PCB and has a pin at its free end which makes primary electrical contact with the circuit on the PCB.

In an alternative embodiment, the spring portion extends in a direction opposite from that of the support legs to provide greater separation between the points where the support legs attach to the PCB and the point of primary electrical contact between the circuit connection portion and the PCB.

DETAILED DESCRIPTION OF THE INVENTION

Figure 1:
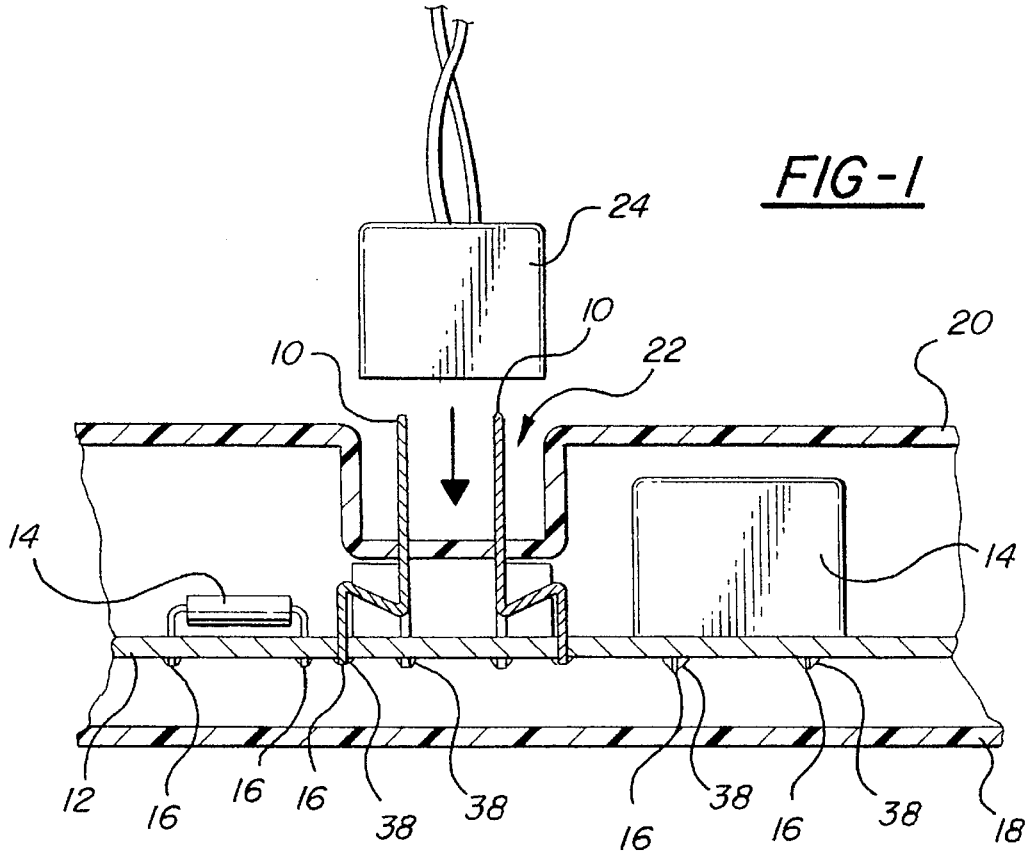
FIG. 1 is a side elevation view of a pair of terminals according to the present invention in a typical operational application.

Referring to FIG. 1, a pair of terminals 10 according to the present invention are shown operatively mounted on a printed circuit board (PCB) 12 along with other circuit elements 14. Electrical leads or pins 16 of terminals 10 and other circuit elements 14 are inserted through holes formed in PCB 12 to make electrical contact with various circuit traces 40,44 (see FIG. 4) formed on the underside of the PCB 12, and solder is applied to the underside of PCB 12 at the locations of pins 16 to provide a positive mechanical and electrical connection between the pins and the traces. Throughout the specification, soldering shall be understood to include all types of manual as well as automated soldering procedures.

PCB 12 is enclosed by a lower module cover 18 and an upper module cover 20, with the upper ends of terminals 10 extending upwardly through holes formed in the bottom of a recessed connector receptacle 22 formed in upper module cover 20. A wiring connector 24 contains a pair of electrical contacts (not shown) and is positioned above receptacle 22 as it would be immediately prior to being inserted therein to bring the contacts into electrical connection with terminals 10. It should be noted that the described configuration is by way of example only, and that terminals embodying the present invention are suitable for general use in any device requiring an electrical terminal to be attached to a rigid base such as a printed circuit board.

Figure 2:
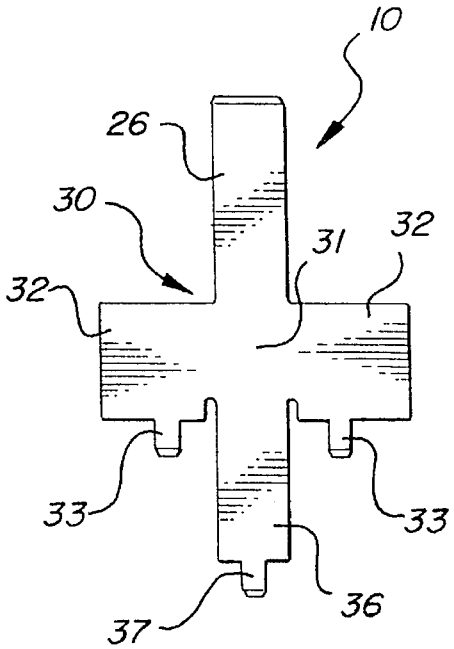
FIG. 2 is a side elevation view of a plate of metal cut to the shape required to form the inventive terminal but prior to being bent to shape.
Figure 3:
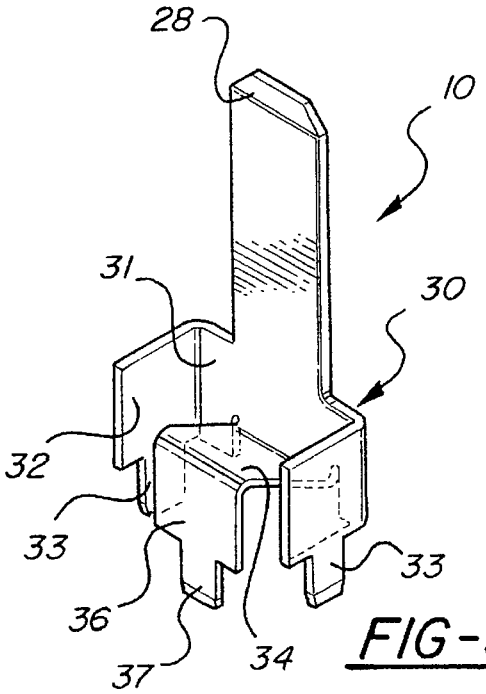
FIG. 3 is a perspective view of a terminal according to the present invention.

Terminal 10 is formed from a single plate of electrically conductive metal such as brass or a copper alloy which is stamped to the shape shown on FIG. 2 and subsequently bent to the form shown in FIG. 3. An elongated blade 26 has an upper end 28 that is bevelled to facilitate insertion into the mating contacts of wiring connector 24. A base 30 is contiguous with blade 26 and includes a central portion 31, a pair of support legs 32 which are bent to extend perpendicularly from the central portion, and support pins 33 which project downward from the lower edges of support legs 32.

A conductive spring 34 extends from the lower edge of base 30 between support legs 32, projecting away from the plane of blade 26 and in the same direction as support legs 32. The end of conductive spring 34 is bent downward to be approximately parallel with blade 26, and to this portion constitutes a circuit connection leg 36. A circuit pin 37 projects downward from the lower end of circuit connection leg 36.

Figure 4:
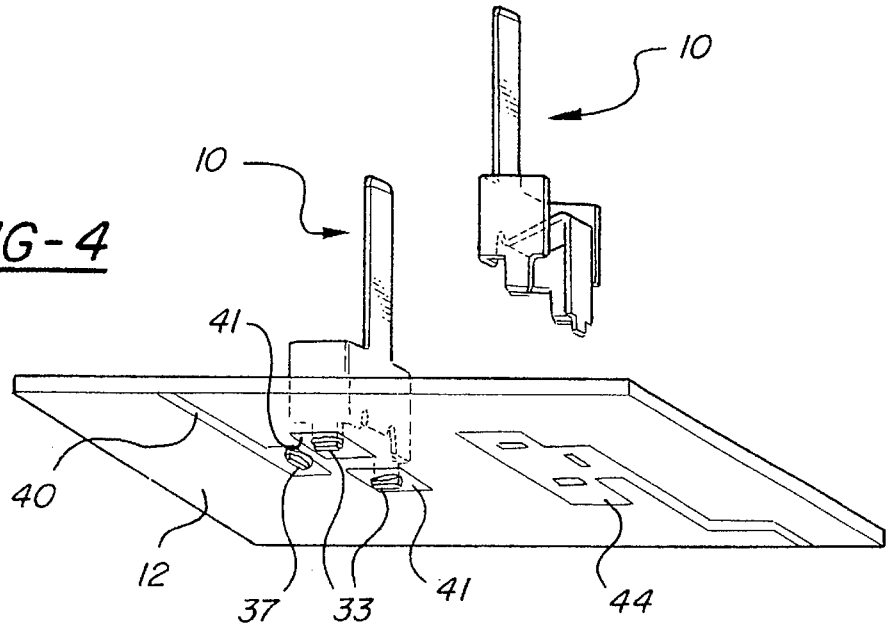
FIG. 4 is a perspective view of the terminal of FIG. 3 operatively mounted on a printed circuit board.

As shown in FIG. 4, terminal 10 is fixed securely to PCB 12 by inserting support pins 33 and circuit pin 37 through the holes formed in PCB 12 and applying solder 38 to the pins where they project from the underside of PCB 12. Circuit pin 37 is soldered into contact with a circuit trace 40 formed on the bottom of PCB 12, while support pins 33 are soldered to solder pads 41. Solder pads 41 are isolated from electrical contact with any circuit of PCB 12 and serve only to facilitate physical connection between terminal 10 and PCB 12. Alternatively, a terminal 10 may be soldered into connection with a multi-pin circuit trace 44 as shown on the right-hand side of the PCB 12 shown in FIG. 4, thus providing a high level of connection redundancy for that particular circuit. Other circuit trace patterns may be desired for a particular application, for example with either one or both of support pins 33 soldered to a second circuit trace electrically isolated from that of circuit pin 37.

The described geometry of terminal 10 results in blade 26 and base 30 forming a rigid load-bearing path that effectively transfers any loadings applied on blade 26 to PCB 12 at the points where support pins 33 attach thereto. Conversely, conductive spring 34 forms a much more flexible link between blade 26 and PCB 12 so that, while electrical continuity between blade 26 and circuit pin 37 is not compromised, physical loads applied to blade 26 are not effectively transferred to the soldered connection between circuit pin 37 and PCB 12.

Circuit pin 37 thus serves as the sole or primary point of electrical contact between terminal 10 and PCB 12, and it is substantially isolated from physical loading applied to the terminal such as may be caused by the connecting and disconnecting of wiring connector 24, vibration, or thermal expansion/contraction of the terminal.

Stresses caused by these types of loading, when transferred to the soldered connection between terminal 10 and circuit trace 40 can cause cracks to form in solder 38, with a resulting degradation of the electrical and mechanical characteristics of the soldered joint. By isolating circuit pin 37 from these stresses, its connection with circuit trace 40 is protected from such degradation.

Figure 5:
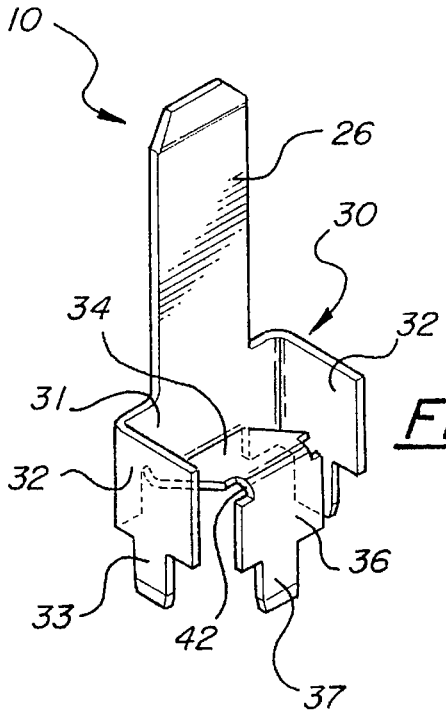
FIG. 5 is a partial perspective view showing a modification of the terminal of FIG. 3.

To further isolate the connection between circuit pin 37 and PCB 12 from stresses, conductive spring 34 may be formed with a reduced width section 42 as shown in FIG. 5. Reduced width section 42 makes conductive spring 34 even more flexible so that, as loads are applied to terminal 10, any stresses applied to conductive spring 34 are concentrated at reduced width section 42 and bending will occur at that point rather than the loads being transferred to circuit pin 37.

It should be noted that support legs 32, because they constitute a significant addition to the surface area of terminal 10, serve as heat dissipating elements, aiding the transfer of heat out of terminal 10 by radiation and/or convection. If necessary for cooling purposes, support legs 32 may be made larger than would be strictly necessary for load carrying purposes.

Figure 6:
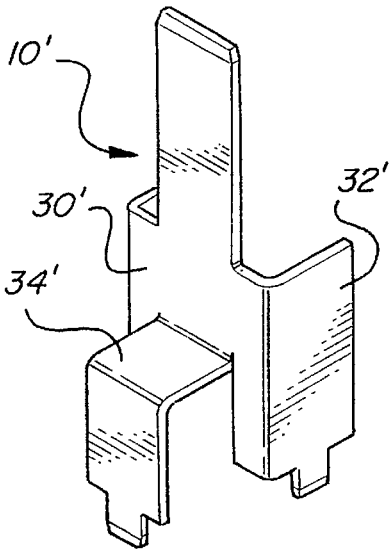
FIG. 6 is a perspective view of a second embodiment of the invention terminal.

An alternative embodiment of the present invention is shown in FIG. 6, wherein elements corresponding to the above described embodiment are indicated by primed numerals. Terminal 10' is substantially identical to the embodiment of FIGS. 1 through 4, with the exception that conductive spring 34' extends away from base 30' in a direction opposite that of support legs 32'. Terminal 10 provides improved heat dissipation qualities as compared to the first described embodiment due to its heat radiating surfaces being spread out over a greater area of PCB 12 and also due to the fact that its geometry presents less obstruction to the flow of cooling air parallel to PCB 12.

Figure 7:
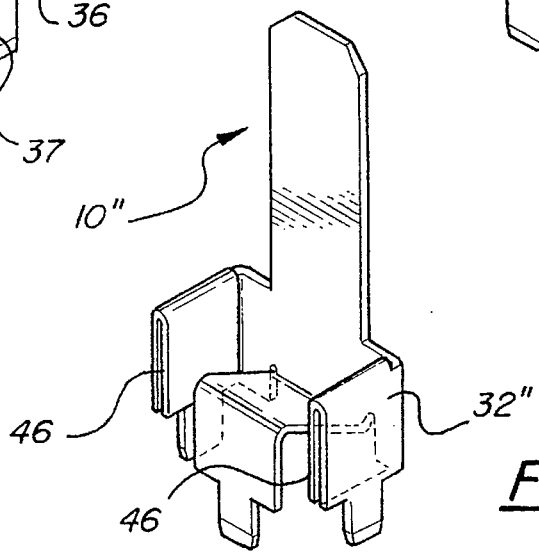
FIG. 7 is a perspective view of a third embodiment of the invention terminal.

FIG. 7 shows another alternative embodiment of the present invention wherein the support legs are formed of a double thickness of material. This is achieved by providing each of the support legs 32" with a flap portion 46 which is folded downward to lay in planar contact with the rest of support leg 32". The resulting double-thick support legs are more rigid than in the previously described embodiments and are less likely to deflect when terminal 10" is subjected to physical loads, particularly those loads which force the terminal downward into contact with PCB 12.

It will be appreciated that the drawings and descriptions contained herein are merely meant to illustrate particular embodiments of the present invention and are not meant to be limitations upon the practice thereof, as numerous variations will occur to persons of skill in the art. For example, blade 26 may be of any shape necessary to make electrical contact with a mating electrical component or a plurality thereof.

I claim:

1. A terminal mountable on a printed circuit board to facilitate electrical contact between a first circuit of the printed circuit board and a separate electrical component, comprising:

a blade portion adapted to engage the separate electrical component and make electrical contact therewith;

a base portion contiguous with the blade portion and adapted to rigidly engage the printed circuit board such that the blade portion and the base portion define a load-bearing path for transferring physical forces applied on the blade portion to the circuit board;

a circuit connection portion adapted to make electrical contact with the first circuit of the printed circuit board when the terminal is mounted thereon; and a conductive spring member joining the base portion with the circuit connection portion, the spring member extending away from the load-bearing path and being spaced from the printed circuit board when the terminal is mounted on the printed circuit board, the spring member being sufficiently flexible to substantially isolate the circuit connection portion from the physical forces applied on the blade portion.

2. A terminal according to claim 1 wherein, when the terminal is mounted on the printed circuit board, the load-bearing path is oriented substantially perpendicular to the printed circuit board and the conductive spring extends in a direction substantially parallel with the printed circuit board.

3. A terminal according to claim 1 formed from a single plate of electrically conductive metal.

4. A terminal according to claim 1 wherein the base portion when engaged with the printed circuit board serves as an additional point of electrical connection between the terminal and the first circuit of the printed circuit board.

5. A terminal according to claim 1 wherein the base portion when engaged with the printed circuit board serves as a point of electrical connection with a second circuit of the printed circuit board, the second circuit being electrically separated from the first circuit of the printed circuit board.

6. A terminal according to claim 1 wherein the base portion includes a pair of load-bearing legs which engage holes formed in the printed circuit board.

7. A terminal according to claim 1 wherein at least a segment of the conductive spring has a cross-sectional area less than that of the circuit connection portion, the reduced area segment constituting a zone of increased flexibility which deflects to absorb stresses applied to the terminal.

8. A terminal mountable on a printed circuit board to facilitate electrical contact between a circuit of the printed circuit board and a separate electrical component, the terminal formed from a single plate of electrically conductive metal and comprising:

a blade portion having a first end adapted to engage and make electrical contact with the separate electrical component and an opposite second end;

a pair of support legs extending perpendicularly from lateral edges of the blade portion adjacent the second end thereof and adapted to rigidly engage the printed circuit board and maintain the blade portion in a plane substantially perpendicular to the printed circuit board;

a spring portion connected to the second end of the blade portion and extending away from the plane of the blade; and a circuit connection portion extending from an end of the spring portion distal from the blade portion and having a free end adapted to make electrical contact with the circuit of the printed circuit board when the terminal is mounted thereon.

9. A terminal according to claim 8 wherein at least part of the spring portion has a cross-sectional area less than that of the circuit connection portion, the reduced area part constituting a zone of increased flexibility which deflects to absorb forces applied to the terminal.

10. A terminal according to claim 8 wherein the support legs are adapted to make electrical contact with a circuit of the printed circuit board when the terminal is mounted on the printed circuit board.

11. A terminal mountable on a printed circuit board to facilitate electrical contact between a first circuit of the printed circuit board and a separate electrical component, comprising:

a blade portion adapted to engage the separate electrical component and make electrical contact therewith;

a base portion contiguous with the blade portion and adapted to be rigidly engagable with the printed circuit board such that the blade portion and the base portion define a load-bearing path for transferring physical forces applied on the blade portion to the circuit board when the terminal is mounted on the printed circuit board, the load-bearing path being oriented substantially perpendicular to the printed circuit board;

a circuit connection portion adapted to make electrical contact with the first circuit of the printed circuit board when the terminal is mounted thereon; and a conductive spring member joining the base portion with the circuit connection portion, the spring member extending away from the load-bearing path in a direction substantially parallel with the printed circuit board when the terminal is mounted on the printed circuit board, and the spring member being sufficiently flexible to substantially isolate the circuit connection portion from the physical forces applied on the blade portion.

12. A terminal mountable on a printed circuit board to facilitate electrical contact between a first circuit of the printed circuit board and a separate electrical component, comprising:

a blade portion adapted to engage the separate electrical component and make electrical contact therewith;

a base portion contiguous with the blade portion and having a pair of load-bearing legs rigidly engagable with holes formed in the printed circuit board such that the blade portion and the base portion define a load-bearing path for transferring physical forces applied on the blade portion to the circuit board;

a circuit connection portion adapted to make electrical contact with the first circuit of the printed circuit board when the terminal is mounted thereon; and a conductive spring member joining the base portion with the circuit connection portion, the spring member extending away from the load-bearing path and being sufficiently flexible to substantially isolate the circuit connection portion from the physical forces applied on the blade portion.

13. A terminal according to claim 12 wherein each of the legs includes a flap portion, the flap portions being folded to lay in planar contact with their respective legs.

* * * * *